US006774583B1

(12) United States Patent
Zeng

(10) Patent No.: US 6,774,583 B1
(45) Date of Patent: Aug. 10, 2004

(54) NUMERICAL CONTROLLED COLOUR LIGHT SOURCE SYSTEM

(75) Inventor: Hongwei Zeng, Rm. 102, 2 Bldg, No. 18, Lane 4, Beimenzhi Str., Huizhou, Guangdong Province (CN)

(73) Assignee: Hongwei Zeng, Guangdong Province (CN)

( * ) Notice: Subject to any disclaimer, the term of this patent is extended or adjusted under 35 U.S.C. 154(b) by 69 days.

(21) Appl. No.: 10/110,749

(22) PCT Filed: Sep. 8, 2000

(86) PCT No.: PCT/CN00/00267

§ 371 (c)(1),
(2), (4) Date: Jul. 10, 2002

(87) PCT Pub. No.: WO01/27524

PCT Pub. Date: Apr. 19, 2001

(30) Foreign Application Priority Data

Oct. 14, 1999 (CN) ..... 99117879

(51) Int. Cl.[7] ..... H05B 37/00

(52) U.S. Cl. ..... 315/312; 315/318; 315/360; 315/362

(58) Field of Search ..... 315/312, 316, 315/324, 318, 360, 362, 317

(56) References Cited

U.S. PATENT DOCUMENTS

| | | | | |
|---|---|---|---|---|
| 4,559,480 A | * | 12/1985 | Nobs | 315/324 |
| 5,483,377 A | | 1/1996 | Kaneda et al. | 359/566 |
| 6,498,440 B2 | * | 12/2002 | Stam et al. | 315/291 |

FOREIGN PATENT DOCUMENTS

| | | | |
|---|---|---|---|
| CN | 2053004 U | * | 2/1990 |
| CN | 2146648 Y | * | 11/1993 |
| CN | 2234679 Y | * | 9/1996 |
| CN | 2290922 Y | * | 9/1998 |
| CN | 1216094 A | * | 5/1999 |

* cited by examiner

*Primary Examiner*—Haissa Philogene
(74) *Attorney, Agent, or Firm*—Merchant & Gould P.C.

(57) ABSTRACT

A numerical controlled colour light source system comprises a colour light-emitting tubes and a numerical control device for controlling said colour light tube. Therein, said colour light tube contains three tricolor light-emitting body which are arranged as equilateral triangle and controlled and drived by said numerical control device, and a light-blending cover shading said light-emitting body, Said light source system adapted to ad, decorating, scene and so on. Because a light tube can generate any color at any time by assembling a series of light-emitting tubes, it is possible to form a colour screen whose color and intensity can be to change optionally. The images and letters on said screen can generate different colour effects according to controlling.

22 Claims, 2 Drawing Sheets

NUMERICAL CONTROLLED COLOUR LIGHT SOURCE SYSTEM

TECHNICAL FIELD OF THE INVENTION

The present invention relates to numerical light source technology, specifically relates to a new type numerical controlled color light source system.

TECHNICAL BACKGROUND

Although application of current light source is not limited in illumination, traditional illuminating tube can't meet the needs in color, intensity and variety for the decoration, advertisement and stage. For example, traditional neon light can illuminate light of different color by filling different gas with tube, but used a certain type of gas is filled with every neon light, any one of certain neon light cannot give off various colors optionally.

OBJECTS OF THE INVENTION

One object of the present invention is to provide a numerical controlled color light source system, which can control one of color light tubes to generate light in various colors, such as red, orange, yellow, green, cyanine, blue, purple based on modem numerical technology. It provides great varieties of color and intensity through combination of light tubes, with the merit of lower cost and wider application.

SUMMARY OF THE INVENTION

The present invention can be implemented by constructing a numerical controlled color light source system, which comprises color light tubes and a numerical device for controlling said color light tubes. Said color light tube comprises three light-emitting bodies arranged as equilateral triangle and a light-blending cover shading said three light-emitting bodies, the glower of said light-emitting body can be controlled by said numerical control device, said three light-emitting bodies are of red, green and blue light-emitting devices respectively.

Among which, said red, green and blue light-emitting devices are LED (Light Emitting Diode) respectively.

Among which, said red, green and blue light-emitting devices comprise neon lights, said system further includes an electronic transformer connected between said neon lights and said numerical control device.

A plurality of said light color tubes can be used in combinations and can be controlled by a numerical control device with multi-output.

The numerical controlled color light source system according to the present invention can be applied in advertisement of indoors or outdoors, decoration and stage. Because one color light tube can generate any color at any time, a number of color light tube in combination can form colorful light screen with changeable color and intensity. Moreover, the words or design on the colorful light screen can be changed according to different control instruction. This system is applicable to various programs to control light-emitting bodies independently or in combination, and there is no restrict for colorful light screen. The system according to the present invention has the merit of lower cost and wider application.

DETAILED DESCRIPTION OF THE INVENTION

Figure 1:
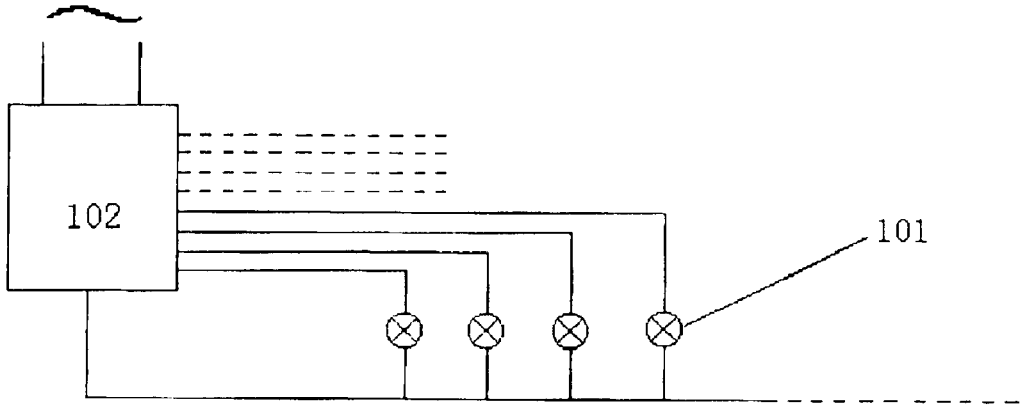
FIG. 1 is structural view of system according to the present invention.

Referring to FIG. 1, this system of the present invention comprises a number of color light tubes 101 and a numerical control device 102 for controlling the color light tubes 101. Thereof, using with combination of said tubes 101 or single tube 101 is allowable, each tube of which is controlled by the numerical control device 102 with whose color, intensity and duration of light emitting. The numerical control device 102 comprises a microprocessor or a timing sequential circuit, its main function is to generate different driving signals in combination and to apply them to respective color light tubes on the basis of demands.

Figure 2:
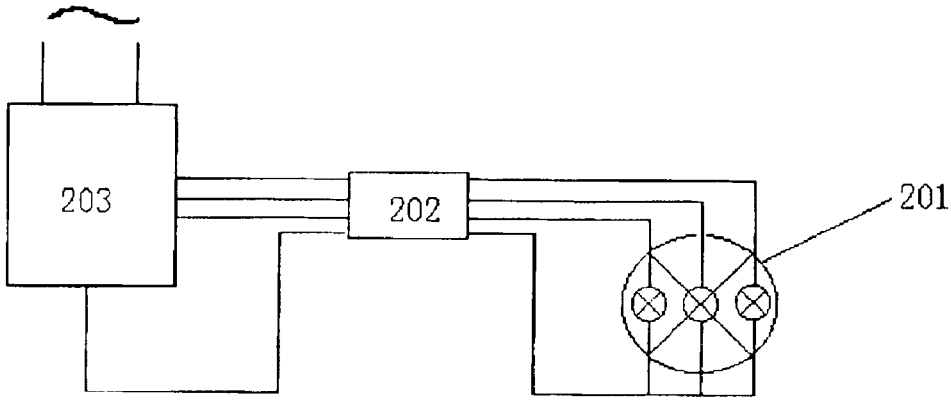
FIG. 2 is structural view showing another embodiment of the present invention.

In embodiment of the invention shown as FIG. 2, as the illuminating unit, color light tube 201 inside contains three neon lights which produce red, green and blue of tricolor, each neon light of which can be controlled respectively. Electronic transformer 202 can be connected between the neon lights and the numerical control device for decreasing output power of the numerical control device. Said numerical control device control three tricolor neon lights through the electronic transformer 202 or drive them directly. In other words, numerical control device 203 drives each neon light of color light tube through electronic transformer 202 according to preset programs at any period of time, and controls the intensity of every neon light at any time circularly.

The processes for driving and controlling light source has the following steps: 1) select or setup illuminating programs in numerical control device 203; 2) fetch and form the corresponding data on the basis of program selected; 3) transform the intensity digital data into analog signal; 4) magnify the analog signal; 5) numerical control device 203 send the magnified signals to electronic transformer 202; 6) electronic transformer 202 send the driving signals to three glowers of every tube to produce corresponding colorful light.

The system according to the present invention can produce multi-color light in one color light tube by method of physical blending. Shown as FIGS. 3–6, three parallel tubes 1 of red, green and blue are fixed in arrangement of equilateral triangle in light-blending cover 2, each of light tube 1 is neon light and light-blending cover 2 is ivory-white glass tube coated with fluorescence powder inside, both ends of the light tube are provided with pins 3 of glowers. Because space among every neon light and the light-blending tube is retained, diffraction will occur, this can make light of different colors blended, result in that generated light will be more soft and comfortable.

Controlling the light of the said neon light at any time manually or automatically can produce main light of red, blue, yellow, green, pink, black and ivory-white and other middle-color light. For example, blue light will be produced if the blue neon light is lighted; red light will be produced if the red neon light is lighted; green light will be produced if the green neon light is lighted; if red and blue neon lights are lighted together, pink light will be produced. If green and blue neon lights are lighted together, black light will be produced; if red, blue and green neon lights are lighted together, white light will be produced. Different effect will occur if proportion of two or three of the light intensity is controlled differently.

For better effect, another light-bending layer can be inserted between tricolor tube 1 and light-blending tube 2.

The said light-emitting bodies can be used of LED (Light Emitting Diode) or its crystal chip to generating red, green and blue light, which the pins of LED can be spread from one side.

Figure 7:
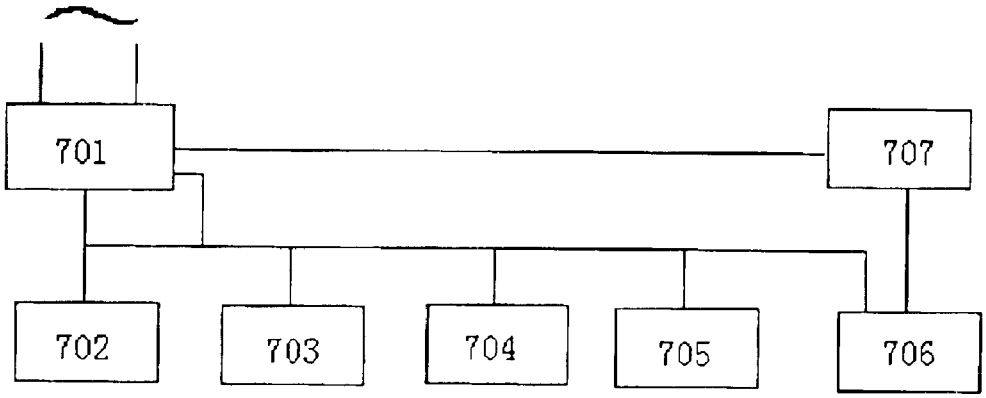
FIG. 7 is a graph illustrating structure of the numerical control device according to the present invention.
Figure 3:
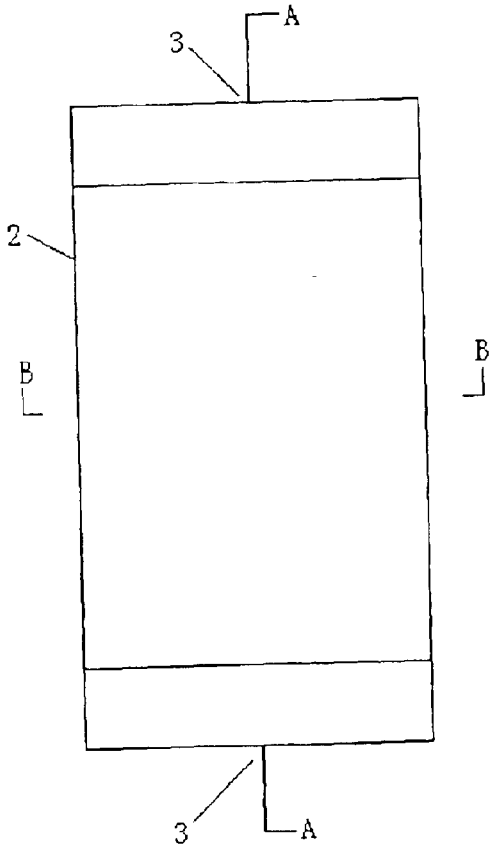
FIG. 3 is a planar view of the color light tube used in the present invention.
Figure 4:
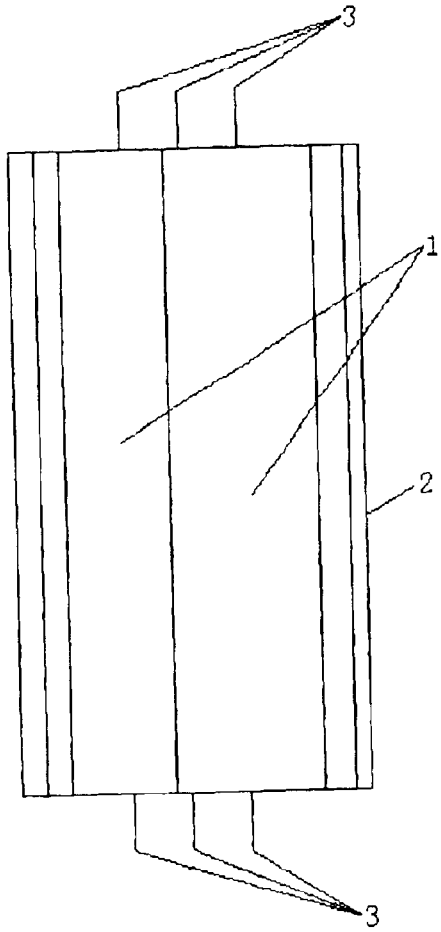
FIG. 4 is a side cross-section taken along line A—A of FIG. 3.
Figure 5:
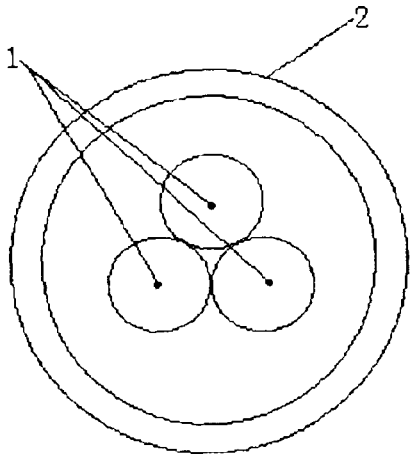
FIG. 5 is a transverse cross-section taken along line B—B of FIG. 3.
Figure 6:
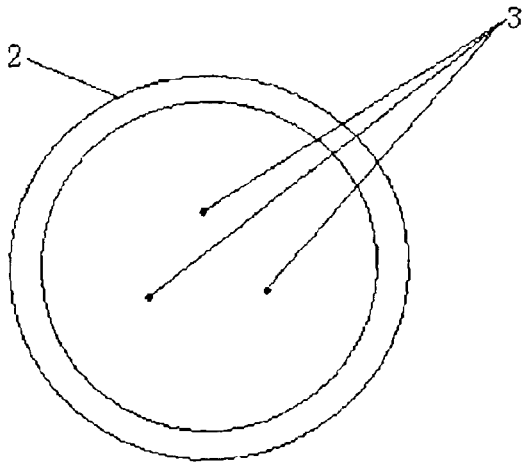
FIG. 6 is planar view showing arrangement of the pins of the color light tube.

In the embodiment of the present invention shown as FIG. 7, the numerical control device includes signal generator 701, counter 702, program setup unit 703, data storage unit 704, DIA converting unit 705, power magnifying unit 706 and load unit 707. Here the load unit 707 can be electronic transformer or LED, or light source of tricolor neon lights. Among which, signal generator 701 used to obtain pulse signal from main power and send them to counter 702, and then provide DC to every unit. Counter 702 is used to produces timing sequential signal for controlling whole illuminating process. Program setup unit 703 has following function means: 1) setup of time to start and stop; 2) setup of color; 3) setup of intensity. For example, the program setup unit 703 can be lighting mode setting switch, or an interface which can receive local or distant lighting program instruction. Data storage unit 704 will memorize lighting data formed by program setup unit 703, including corresponding preset program for tricolor tube. For example, each of tricolor can be expressed with four bits, red, green and blue color can be expressed with binary system respectively, for instance, green color as (0,1,0); red color as (1,0,0); blue color as (0,0,1); red and blue color as (1,1,0). If intensity is different, it can be expressed as (4,9,0), and so on. D/A converting unit 705 can transform data provided by data memory unit 704 into analog signal, power-magnifying unit 706 will magnify the analog signal provided by D/A transformation unit 705 and then sent to load unit 707.

Besides intensity of color, other aspects under control includes duration and sequence. For example, there are different program and data for intensity circulation in single color and for multi-color circulation.

What is claimed is:

1. A numerical controlled color light source system, comprising:

color light tubes and a numerical control device for controlling said color light tubes;

wherein each of said color light tubes comprises three light-emitting bodies arranged as an equilateral triangle and a light-blending cover shading said three light-emitting bodies;

glowers of said three light-emitting bodies are driven and controlled by said numerical control device; and said three light-emitting bodies arranged as said equilateral triangle comprise neon lights of red, green and blue color respectively.

2. The System according to claim 1, further comprising an electronic transformer connected between the outputs of said numerical control device and said color light tubes.

3. The System according to claim 2, wherein said numerical control device comprises multi-outputs, and said System comprises a plurality of said color light tubes arranged as required and controlled by said numerical control device with multi-outputs.

4. A numerical controlled color light source system, comprising:

color light tubes and a numerical control device for controlling said color light tubes;

wherein each of said color light tubes comprises three light-emitting bodies arranged as an equilateral triangle and a light-blending cover shading said three light-emitting bodies;

glowers of said three light-emitting bodies are driven and controlled by said numerical control device; and said three light-emitting bodies arranged as said equilateral triangle comprise LEDs of red, green and blue color respectively.

5. The System according to claim 4, wherein said numerical control device comprises multi-outputs, and said System comprises a plurality of said color light tubes arranged as required and controlled by said numerical control device with multi-outputs.

6. A numerical controlled color light source system comprising:

a plurality of color light tubes (101) and a numerical control device (102) for controlling said color light tubes;

wherein each of said color light tubes (101) comprises tricolor units generating light of red, green and blue respectively under control of said numerical control device (102);

said numerical control device (203) accepts illuminating program data from setting switch, and transforms said data representing illuminating information into an analog signal, magnifying said analog signal to drive said tricolor units directly or through an electronic transformer (202); and said tricolor units are arranged as an equilateral triangle and comprise neon lights of red, green and blue color respectively.

7. The System according to claim 6, wherein said numerical control device (102) comprises a microprocessor.

8. The System according to claim 6, wherein said numerical control device (102) comprises a timing sequential circuit.

9. A numerical controlled color light source system, comprising:

a plurality of color light tubes (101) and a numerical control device (102) for controlling said color light tubes (101) separately;

wherein each of said color tubes (101) comprises tricolor units generating light of red, green and blue under control of said numerical control device (102);

said numerical controlled device (203) drives said tricolor unit to generate lights of red, green and blue according to a user's setup;

said color light tube generates several colors through physical light-blending while using only one tube, each of said color light tubes being constructed such way that said three parallel neon lights (1) for generating red, green and blue light respectively are fixed as an equilateral triangle inside a light-blending cover (2), and each of said neon lights (1) is spaced from said light-blending cover (2).

10. The System according to claim 9, wherein pins (3) of said color light tube are spread from both sides of said tube.

11. The System according to claim 9, wherein said light-blending cover (2) comprises an ivory-white glass tube coated with fluorescence powder inside.

12. The System according to claim 11, wherein pins (3) of said tube are spread from both sides of said tube.

13. The System according to claim 10, further comprising a light-blending layer between said tricolor light tubes (1) and said light-blending cover (2).

14. The System according to claim 11, further comprising a light-blending layer between said tricolor light tubes (1) and said light-blending cover (2).

15. The System according to claim 12, further comprising a light-blending layer between said tricolor light tubes (1) and said light-blending cover (2).

16. A numerical controlled color light source system, wherein it comprising a plurality of color light tubes (101) and a numerical control device (102) that controls said color light tubes (101) separately;

wherein each of said color light tubes (101) comprises tricolor units generating red, green and blue light respectively under control;

said numerical control device comprises:

a program setup unit (703) for setting up an illuminating program;

a signal generator (701);

a counter (702) for providing said program setup unit (703) with a timing sequential signal;

a data storage unit (704) connected to said program setup unit (703);

a D/A converting unit (705) which receives data from said data storage unit (704) through a bus and transforms said data into an analog signal;

a power magnifying unit (706) which magnifies said analog signal from said D/A converting unit (705);

a load unit (707) driven by said power magnifying unit (706); and said program setup unit (703) has function means comprising: 1) Time setup to begin and end; 2) Color setup; 3)Intensity setup.

17. The System according to claim 16, wherein in said color light tubes (1) said tricolor units generating red, green and blue light are fixed in an arrangement of an equilateral triangle inside a light-blending cover (2), and each of said neon lights (1) is spaced from said light-blending cover (2).

18. The System according to claim 17, wherein said light-blending cover (2) comprises an ivory-white glass tube coated with fluorescence powder inside.

19. The System according to claim 18, wherein pins of said tube are spread from both sides of said tube.

20. The System according to claim 18, further comprising a light-blending layer located between said tricolor light (1) and said light-blending cover (2).

21. The System according to claim 16, wherein said load unit 707 comprises an electronic transformer and said tricolor units comprise neon lights driven by said electronic transformer.

22. The System according to claim 16, wherein said load unit 707 comprises LEDs.

* * * * *